US008769800B2

(12) United States Patent
Ghibellini

(10) Patent No.: US 8,769,800 B2
(45) Date of Patent: Jul. 8, 2014

(54) PROCESS FOR MAKING CONICAL SPARE PARTS FOR REFINERS FOR THE PRODUCTION OF PAPER

(75) Inventor: Luca Ghibellini, San Giovanni Lupatoto (IT)

(73) Assignee: Officine Airaghi S.R.L., San Giovanni Lupatoto (IT)

( * ) Notice: Subject to any disclaimer, the term of this patent is extended or adjusted under 35 U.S.C. 154(b) by 1220 days.

(21) Appl. No.: 12/276,217

(22) Filed: Nov. 21, 2008

(65) Prior Publication Data

US 2009/0134258 A1 May 28, 2009

(30) Foreign Application Priority Data

Nov. 23, 2007 (IT) ..... VR2007A0170

(51) Int. Cl.
*B23P 13/04* (2006.01)
*D21D 1/22* (2006.01)

(52) U.S. Cl.
CPC ..... *D21D 1/22* (2013.01)
USPC ..... 29/558; 241/294; 241/298

(58) Field of Classification Search
USPC ..... 29/557, 558, 525.01, 428; 241/291, 241/298, 261.1, 259.1, 244, 294, 295, 293
See application file for complete search history.

(56) References Cited

U.S. PATENT DOCUMENTS 2,778,282 A * 1/1957 Sutherland ..... 241/261.1
3,278,127 A * 10/1966 Russell ..... 241/294
3,305,183 A * 2/1967 Morden ..... 241/260.1
3,614,826 A * 10/1971 Pilao ..... 29/434
4,681,270 A * 7/1987 Oberhofer ..... 241/298
4,884,331 A * 12/1989 Hinshaw ..... 29/558
5,249,734 A * 10/1993 Pilao ..... 228/182
5,836,530 A * 11/1998 Pilao ..... 241/261.1
6,053,440 A * 4/2000 LaRiviere ..... 241/46.01
7,013,551 B2 * 3/2006 Green et al. ..... 29/559
7,263,755 B2 * 9/2007 Lange ..... 29/428
7,334,333 B2 * 2/2008 Palazzini et al. ..... 29/889.721
7,614,129 B2 * 11/2009 Matthew ..... 29/428
7,779,525 B2 * 8/2010 Matthew ..... 29/428
8,028,946 B2 * 10/2011 Vuorio ..... 241/261.1
2002/0070303 A1 * 6/2002 Johansson et al. ..... 241/261.3
2004/0144875 A1 * 7/2004 Johansson ..... 241/261.1
2005/0161542 A1 * 7/2005 Theut ..... 241/298
2006/0113415 A1 * 6/2006 Antensteiner ..... 241/298
2006/0151648 A1 * 7/2006 Vuorio et al. ..... 241/261.2
2006/0231649 A1 * 10/2006 Demler et al. ..... 241/21
2007/0164143 A1 * 7/2007 Sabourin et al. ..... 241/261.2
2008/0025814 A1 * 1/2008 Raymond ..... 411/354
2008/0041997 A1 * 2/2008 Gingras ..... 241/261.3

* cited by examiner

*Primary Examiner* — David Bryant
*Assistant Examiner* — Christopher M Koehler
(74) *Attorney, Agent, or Firm* — Greenberg Traurig, LLP

(57) ABSTRACT

A process for making spare parts for refiners used for producing paper, in particular for making refiners for preparing paper pulps, where the pulp enters at one end and exits on the other side, passing through a rotary body or rotor or male component equipped with bars (or grooves) and a casing or stator or female component bearing fixed counter-bars. This process includes mechanical machining of unmachined sectors; routing or mechanical machining of the machined sectors to obtain a set of bars or grooves or holes; putting together the cone (rotor or stator by joining all of the sectors to the supporting flanges; mechanical machining (turning and grinding) to finish the cone; and balancing of the rotor or stator.

18 Claims, 1 Drawing Sheet

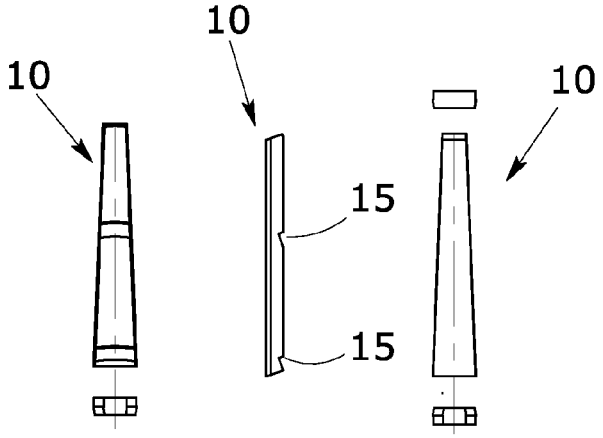
Fig. 1
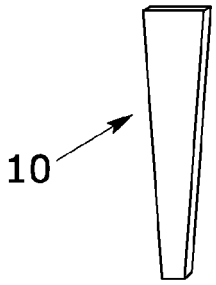
Fig. 2
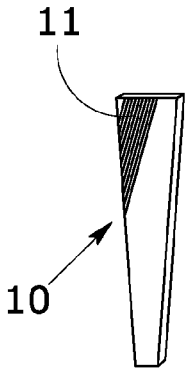
Fig. 3
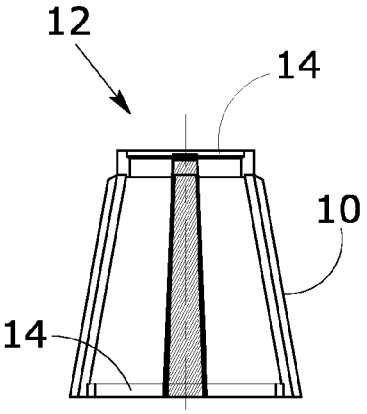
Fig. 4
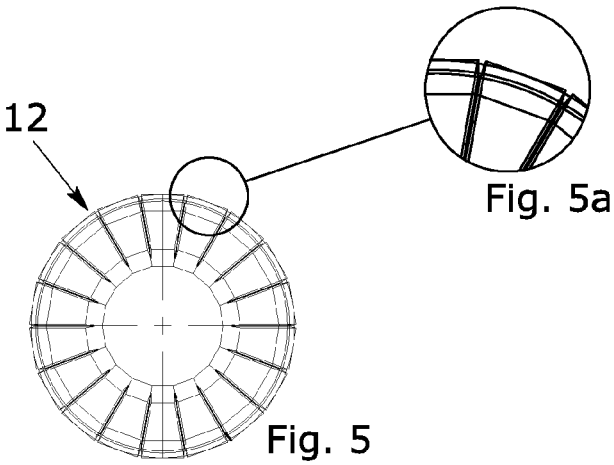
Fig. 5a
Fig. 5
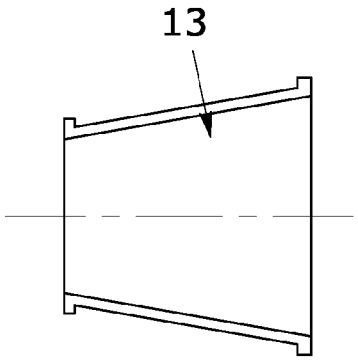
Fig. 6
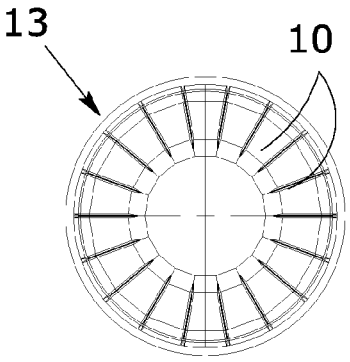
Fig. 7

PROCESS FOR MAKING CONICAL SPARE PARTS FOR REFINERS FOR THE PRODUCTION OF PAPER

RELATED APPLICATION

This application claims the benefit of and priority to Italian Application No. VR2007A000170, filed Nov. 23, 2007, the content of which is incorporated by reference herein in its entirety.

BACKGROUND

1. Field

The present invention relates to a process for making spare parts for refiners used for the production of paper.

More particularly, the present invention relates to a process which allows spare parts to be made for refiners for the preparation of paper pulps. The pulp enters them at one end and exits on the other side, passing through a rotary body equipped with bars or in any case having alternating gaps and solid areas (bars, holes, etc. made in mechanical machining processes and made on one or both faces) and a casing equipped with fixed counter-bars. Said alternation of gaps and solid areas is also referred to as the "set of bars".

The process in accordance with the invention allows a reduction in the times and costs for the production of such spare parts for refiners, also obtaining a high level of precision in the finished product, with the possibility of making spare parts for any refiners on the market, even the older ones with a narrow angle, which in this way could be used to produce very particular papers which currently require more modern refiners.

The present invention may be applied in mechanics applied to the papermaking sector.

2. General Background

It is known that during early papermaking, the pulp was prepared in an aqueous suspension in vats in which the mould was immersed.

With the passage of time various machines for preparing paper pulps were made, and in addition to Hollander beaters, which operate with a periodic cycle, use is now made of continuous cycle refiners such as disk refiners or conical refiners. In the latter the pulp enters at one end and exits on the other side, passing through a rotary cone equipped with bars and a casing equipped with fixed counter-bars.

In contrast, in disk refiners, the pulp is treated by rotating disks.

A disk refiner basically consists of two/four metal disks positioned one in front of another, whose opposite surfaces have grooves in them directed towards the outside, the dimensions and shape varying according to the stage/degree of refining.

Each pair consists of one fixed disk and another disk which rotates rapidly and which may be moved away from or towards the first. The pulp is forced to pass inside the two plates.

The pulp, pushed by the action of the rotating disk and thrown outwards by the centrifugal force, passes through the gap between the grooves and is subjected to a mechanical refining action.

Generally, for the production of refiner disks a technique is used according to which the shape of the parts with the grooves is created using casting processes, or welding or mechanical machining processes such as routing.

It was found that the former two production methods applied in making conical bodies did not allow the aims to be achieved in terms of quality of the finished product, since in most cases the set of bars created with casting or assembly or welding processes was imprecise. It was also difficult to maintain the size of the bar and of the space for a predetermined period of use, and it was impossible to make extremely fine bars (even less than 1 mm thick) or to modify the angle of the bars.

The prior art production systems are also slow in the implementation and therefore the delivery processes and it is impossible to make spare parts with an extremely fine set of bars for any type of refiner on the market, even those with a narrow angle (older ones) which may be used to produce very particular papers which currently require modern refiners.

SUMMARY

The present invention aims to provide a production process able to eliminate or at least reduce the above-mentioned disadvantages.

The invention also aims to provide the technology for a production process for making spare parts for any type of refiner on the market, through a process which is extremely simple to implement in order to obtain various advantages for the user, including the possibility of obtaining an extremely precise set of bars because they are made using a machine tool, the possibility of maintaining the size of the bar and of the space for the whole working life of the spare part, which is impossible with casting processes, and also the possibility of making an extremely fine bar, even less than 1 mm thick.

With the use of the production process in accordance with the invention there is also the possibility of making any type of set of bars or holes or in any case any alternation of solid areas and gaps, also modifying the angle of the bars, also both implementing the process and delivering the product rapidly.

Another advantage which can be achieved with the process disclosed relates to the possibility of making the above-mentioned spare parts for any type of refiner on the market, even those with a narrow angle (older ones) which can be used to produce very particular papers which currently require modern refiners.

The production process disclosed also offers many advantages for the manufacturer, including proposing a product which has no competitors, making a set of bars that are even very fine which cannot be created using other methods, and internalising the product, whereas at present with casting the product depends more than 60% on the foundry. Therefore, it is possible to free oneself from specialised foundries.

Moreover, the process disclosed offers the possibility for the manufacturer to cut delivery times (for example from around 5-6 months to 1 month), and to have an extremely reliable and precise product, as well as the possibility of reducing the manpower needed to make the spare part, instead using machines.

This is achieved by means of a process for making spare parts for refiners for the production of paper, preferably conical refiners, whose features are described in the main claim.

The dependent claims of the solution disclosed outline advantageous embodiments of the invention.

The process in accordance with the invention therefore involves implementing the following steps:

1. Purchase of unmachined sectors (cast or made from plasma or laser cut sheet metal);

2. Mechanical machining of unmachined sectors for bearing the bars and grooves;

3. Production of the set of bars, using computerised numeric control machines for routing/machining pre-machined sectors, through stock removal;

4. Putting together the cone by joining (by welding or bolting, or another method) all sectors bearing the bars and grooves to the supporting flanges;

5. Mechanical machining (turning and grinding) to finish the cone;

6. Rotor balancing;

7. Packing.

DRAWINGS

Other features and advantages of the invention are apparent in the description which follows, of a preferred, non-restricting embodiment of the invention, with reference to the accompanying drawings, in which:

FIG. 1 is a schematic view of a sector which can be joined together to form a rotor or male component or a stator or female component;

FIG. 2 is a schematic view of a sector before machining;

FIG. 3 is a schematic view of an example sector on which grooves have been made by CNC machining or routing;

FIG. 4 is a schematic lateral section of a rotor or male component made by joining two or more sectors bearing the bars and grooves of the previous figures;

FIGS. 5 and 5*a* are a schematic horizontal section of a rotor made by assembling two or more sectors bearing the bars and grooves;

FIG. 6 is a cross-section of a stator or female component made using the method in accordance with the invention in vertical section;

FIG. 7 is a schematic view of a stator or female component in accordance with the invention seen from the top.

DETAILED DESCRIPTION

With reference to the accompanying drawings, the process disclosed involves implementing a plurality of steps for making the working devices of spare parts for refiners used for producing paper.

As shown in the Figures, the basic working components of the spare parts for refiners for producing paper in accordance with the invention substantially consist of sectors 10, consisting of a piece of metal material, made for example from plasma or laser cut sheet metal.

The unmachined part made of sheet metal or sector 10 is then shaped by mechanical machining of the unmachined sector, to obtain the outer shape of the part.

Once the outer shape of the part has been obtained, the part is subjected to a second machining process, that is to say, routing or stock removal from the sectors machined, to obtain the grooves or set of bars 11 of the working surface of the components.

The grooves or set of bars 11 are made on the outside or on the inside of the sector (or on both), depending whether or not the aim is to produce a rotor or male component 12 or a stator or female component 13 for the refining manufactured article.

When the grooves have been made, in a third working step the various parts or sectors bearing the bars and grooves are drawn near each other on the edges for reciprocal connection, thus putting together the cone. This step is concluded by welding or bolting, or more generally, fixing, all of the sectors 10 to the supporting flanges 14.

To allow the use of the supporting flanges, each sector comprises one or more recesses 15 made in the central part or in other locations considered more appropriate according to the methods of assembly.

When the third working step is complete, the rotor or male component 12 and the stator or female component 13 go on to the fourth step, with machining of the surfaces drawn near each other, that is to say, turning and grinding, to finish the cone and then rotor balancing.

As can be seen, the production system described allows the production of any type of manufactured article, both in terms of size and in terms of shaping. That is to say, from truncated-cone shapes which are almost cylindrical, i.e.: with a taper tending towards 90°, to semi-flat truncated-cone shapes, i.e.: with a taper tending towards zero.

As already indicated, the production process disclosed allows the above-mentioned spare parts to be made for any type of refiner on the market, even those with a narrow angle (older ones) which can be used to produce very particular papers which currently require modern refiners.

More generally, the production process disclosed allows all of the advantages previously described to be obtained and in particular the possibility of obtaining an extremely precise set of bars because they are made using a machine tool, the possibility of maintaining the size of the bar and of the space for the whole working life of the spare part, which is impossible with casting processes, and also the possibility of making an extremely fine bar, even less than 1 mm thick.

With the use of the production process in accordance with the invention there is also the possibility of making any type of set of bars, also modifying the angle of the bars and also both implementing the process and delivering the product rapidly.

The invention is described above with reference to a preferred embodiment. However, obviously the invention is susceptible of many variations without thereby departing from the inventive concept, consisting of technical equivalents.

What is claimed:

1. A process for making a rotor for a refiner used for preparing paper pulps, where the pulp enters at one end and exits at another end of said refiner, passing through said rotor equipped with bars and a stator bearing fixed counter-bars, whereby both the rotor and the stator are constituted by a series of metal sectors placed adjacent to each other, said process comprising the following steps:

a) mechanical machining of unmachined metal pieces to obtain said sectors, whereby each sector is machined to obtain, on a surface thereof, one or more recesses suitable for co-operating with one or more flanges, b) routing or mechanical machining of said sectors by a machine tool to obtain on a another surface thereof a set of said bars;

c) assembling said sectors by placing them adjacent to each other on said flanges to obtain said rotor having a conical shape;

d) fixing the adjacent sectors to each other and to said flanges in order to obtain a said rotor in which said bars are directly obtained on said another surface of each of said sectors, without any sector supporting plate;

e) mechanical turning and grinding of said rotor to obtain a finished conical shape; and f) balancing said rotor.

2. A process according to claim 1, wherein said sectors are obtained from a plasma or laser cut sheet metal.

3. A process according to claim 1, wherein said sectors are obtained through casting.

4. A process according to claim 1 wherein the thickness of said bars is less than 1 mm.

5. A process according to claim 1, wherein the thickness of said bars is 1 mm or more.

6. A process according to claim 1 wherein the finished conical shape is a frusto-conical shape with a taper tending towards 90° or a semi-flat truncated-cone shape with a taper tending towards zero.

7. A process according to claim 1 wherein the sectors are developed without a welding step.

8. A process according to claim 1 wherein the routing or mechanical machining is a milling operation.

9. A process for making a stator for a refiners used for preparing paper pulps, where the pulp enters at one end and exits at another end of said refiner, passing through a rotor equipped with bars and a stator bearing fixed counter-bars, whereby both said rotor and said stator are constituted by a series of metal sectors placed adjacent to each other, said process comprising the following series of steps:

a) mechanical machining of unmachined metal pieces to obtain said sectors, whereby each sector is machined to obtain, on a surface thereof, one or more recesses suitable for co-operating with one or more flanges;

b) routing or mechanical machining of said sectors by a machine tool to obtain on another surface thereof a set of said bars;

c) assembling said sectors by placing them adjacent to each other on said flanges to obtain said stator having a conical shape;

d) fixing the adjacent sectors to each other and to said flanges in order to obtain said stator in which said bars are directly obtained on said another surface of each of said sectors, without any sector supporting plate;

e) mechanical turning and grinding of said stator to obtain a finished conical shape; and f) balancing said stator.

10. A process according to claim 9, wherein said sectors are obtained from a plasma or laser cut sheet metal.

11. A process according to claim 9, wherein said sectors are obtained through casting.

12. A process according to claim 9, wherein said sectors are obtained through casting.

13. A process according to claim 9 wherein the thickness of said bars is less than 1 mm.

14. A process according to claim 9 wherein the finished conical shape is a frusto-conical shape with a taper tending towards 90° or a semi-flat truncated-cone shape with a taper tending towards zero.

15. A process according to claim 9 wherein the sectors are developed without a welding step.

16. A process according to claim 9 wherein the routing or mechanical machining is a milling operation.

17. A process for making a rotor for a refiner used for preparing paper pulps, where the pulp enters at one end and exits at another end of said refiner, passing through a said rotor equipped with bars and a stator bearing fixed counter-bars, whereby both the rotor and the stator are constituted by a series of metal sectors placed adjacent to each other, said process consisting of the following steps:

a) mechanical machining of unmachined metal pieces to obtain said sectors, whereby each sector is machined to obtain, on a surface thereof, one or more recesses suitable for co-operating with one or more flanges, b) routing or mechanical machining by milling of said sectors by a machine tool to obtain on a another surface thereof a set of said bars;

c) assembling said sectors by placing them adjacent to each other on said flanges to obtain a said rotor having a conical shape;

d) fixing the adjacent sectors to each other and to said flanges in order to obtain a said rotor in which said bars are directly obtained on said another surface of each of said sectors, without any sector supporting plate;

e) mechanical turning and grinding of said rotor to obtain a finished conical shape; and f) balancing said rotor.

18. A process according to claim 17 wherein the sectors are developed without a welding step.

* * * * *